US008943771B2

(12) United States Patent
Garcia

(10) Patent No.: US 8,943,771 B2
(45) Date of Patent: Feb. 3, 2015

(54) LIGHTWEIGHT SLAB OR SIMILAR STRUCTURAL ELEMENT WHICH CAN RECEIVE EQUIPMENT THAT IS ACCESSIBLE AND THAT CAN EXTEND THROUGH THE SLAB

(76) Inventor: Alberto Alarcon Garcia, Madrid (ES)

( * ) Notice: Subject to any disclaimer, the term of this patent is extended or adjusted under 35 U.S.C. 154(b) by 0 days.

(21) Appl. No.: 13/807,609

(22) PCT Filed: Jun. 24, 2011

(86) PCT No.: PCT/ES2011/070458

§ 371 (c)(1),
(2), (4) Date: Mar. 8, 2013

(87) PCT Pub. No.: WO2012/001193

PCT Pub. Date: Jan. 5, 2012

(65) Prior Publication Data

US 2013/0160385 A1 Jun. 27, 2013

(30) Foreign Application Priority Data

Jun. 28, 2010 (ES) ..... 201000839

(51) Int. Cl.
*E04B 1/16* (2006.01)
*E04B 1/20* (2006.01)
(Continued)

(52) U.S. Cl.
CPC . *E04B 5/48* (2013.01); *E04B 5/326* (2013.01); *E04B 5/328* (2013.01); *E04C 2/521* (2013.01); *E04G 11/36* (2013.01)
USPC ..... 52/340; 52/341; 52/319; 52/33

(58) Field of Classification Search
CPC ..... E04B 5/48; E04B 5/326; E04B 1/04; E04B 1/06
USPC ..... 52/340, 341, 319, 33
See application file for complete search history.

(56) References Cited

U.S. PATENT DOCUMENTS 2,534,580 A 12/1950 Edwards
3,229,437 A 1/1966 Mountford
(Continued)

FOREIGN PATENT DOCUMENTS

EP 1236843 9/2002
FR 551370 4/1923
(Continued)

OTHER PUBLICATIONS

PCT Written Opinion dated Nov. 17, 2011.

*Primary Examiner* — Mark Wendell
(74) *Attorney, Agent, or Firm* — Dickinson Wright PLLC

(57) ABSTRACT

A lightweight slab including two main parallel reticular reinforcements (5)(6) separated by secondary reinforcements and arranged to form a double diagonal, a single diagonal or to be perpendicular in relation to the main reinforcements. All of the reinforcements are embedded in a volume of concrete filling which covers and protects such reinforcements and which is defined by a suitable formwork or mould which creates voids in a hypothetical prismatic volume and which is formed by hollow prismatic or truncated-pyramid-shaped volumes with smooth edges and vertices that improve structural strength and facilitate the extraction of the moulds. The filling includes open holes (4, 3) in those portions that do not interfere with the secondary and main reinforcements to form a succession of nodes connected at the top and bottom by holes that can be accessed from the lower and/or upper level (4) and, internally, hollows (2) connected by side holes (3).

11 Claims, 19 Drawing Sheets

(51) Int. Cl.

| | |
|---|---|
| ***E04H 3/04*** | (2006.01) |
| ***E04B 5/48*** | (2006.01) |
| ***E04B 5/32*** | (2006.01) |
| ***E04C 2/52*** | (2006.01) |
| ***E04G 11/36*** | (2006.01) |

(56) References Cited

U.S. PATENT DOCUMENTS

| | | | | |
|---|---|---|---|---|
| 3,475,529 | A * | 10/1969 | Lacy | 264/228 |
| 3,495,367 | A | 2/1970 | Hideya | |
| 4,637,184 | A * | 1/1987 | Radtke et al. | 52/220.4 |
| 5,396,747 | A * | 3/1995 | Breuning | 52/516 |
| 8,028,485 | B2 * | 10/2011 | Pfeffer et al. | 52/576 |
| 8,322,112 | B2 * | 12/2012 | Luburic | 52/745.13 |
| 2005/0138877 | A1 * | 6/2005 | Inoue et al. | 52/414 |
| 2010/0132290 | A1 * | 6/2010 | Luburic | 52/309.16 |

FOREIGN PATENT DOCUMENTS

| | | |
|---|---|---|
| FR | 2667337 | 4/1992 |
| WO | 0206601 | 1/2002 |
| WO | 03002827 | 1/2003 |
| WO | 2009027628 | 3/2009 |

* cited by examiner

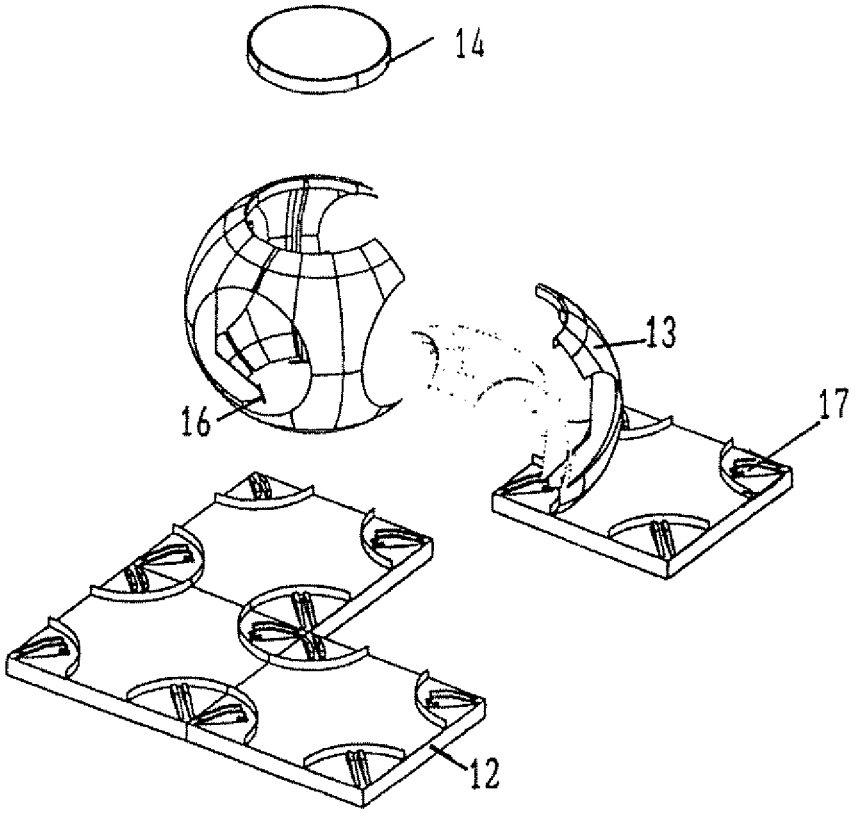
Fig. 13
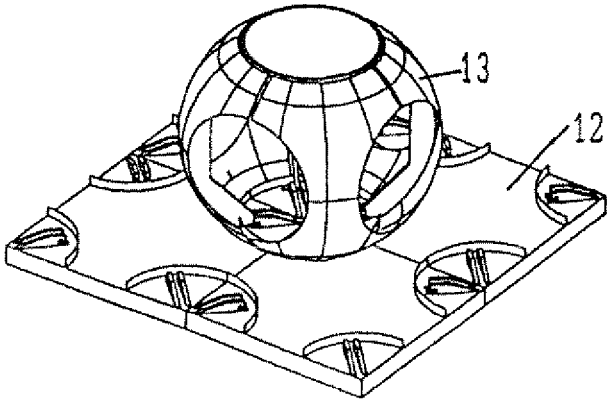

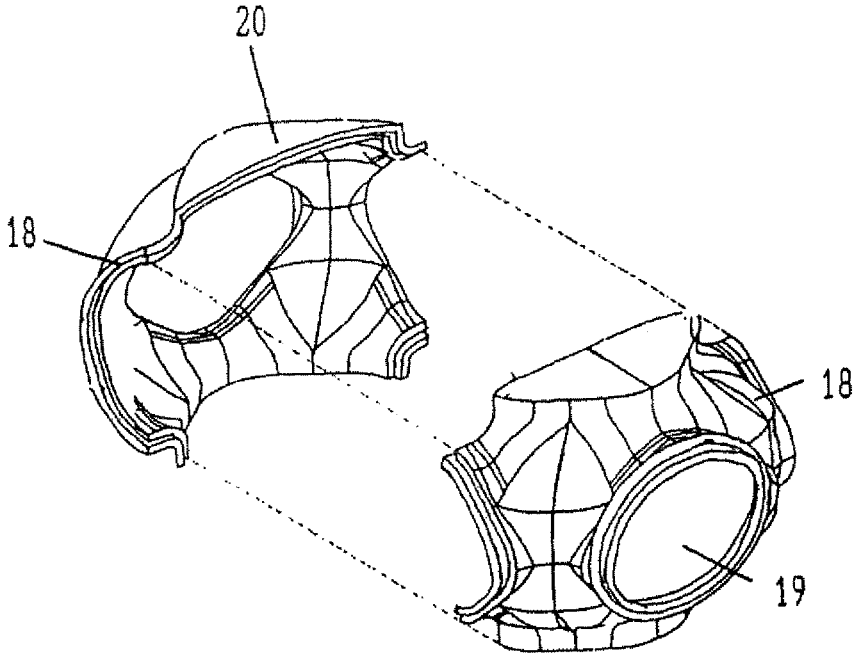
Fig. 15
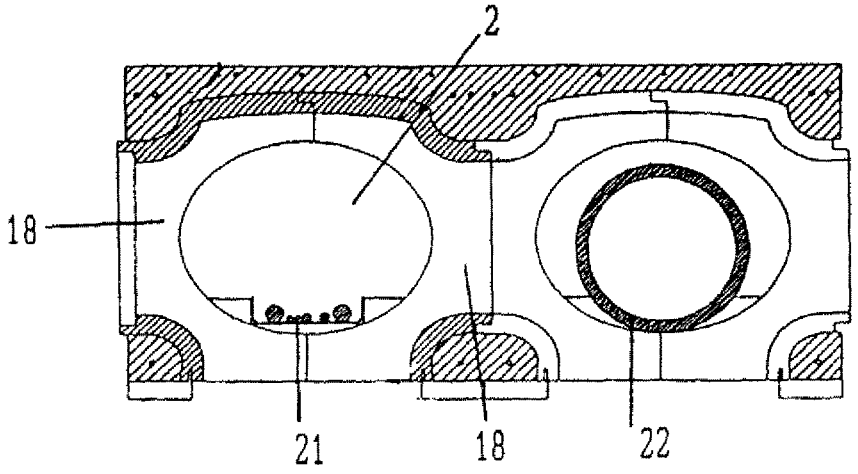

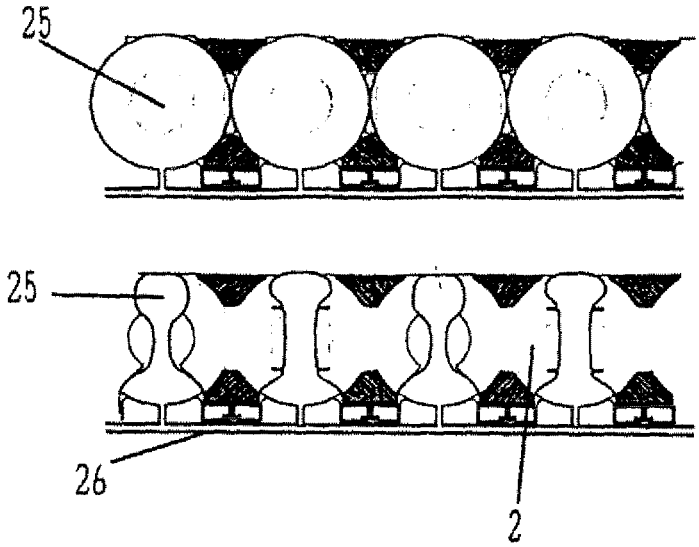
Fig. 17
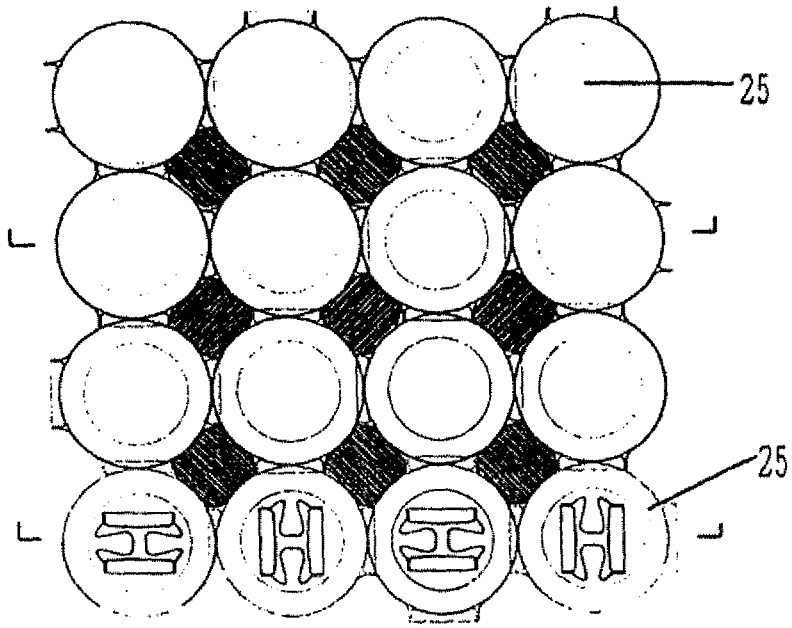

LIGHTWEIGHT SLAB OR SIMILAR STRUCTURAL ELEMENT WHICH CAN RECEIVE EQUIPMENT THAT IS ACCESSIBLE AND THAT CAN EXTEND THROUGH THE SLAB

CROSS-REFERENCE TO RELATED APPLICATION

This U.S. National Stage Patent Application claims the benefit of International Application serial number PCT/ES2011/070458 filed Jun. 24, 2011 and Spanish application serial number 201000839 filed Jun. 28, 2010, the entire disclosures of the applications being considered part of the disclosure of this application, and hereby incorporated by reference.

The object of the invention is a slab, or a similar lightweight structural element, where accessible facilities can be placed This invention, as its title suggests, is about a slab-like structure with inner steel reinforcements, normally with a concrete filling and with some formwork elements that properly shape the slab during the building process.

Several building systems are known for this kind of structures. They are usually voided or solid elements without the possibility of accessible spaces. The floor is placed above this structure and, at the bottom, a ceiling or any other finish according to the use needed. The facilities (electricity, gas, telephone, water, etc.) are hidden by the suspended ceiling laid under the flooring system, or inside the walls. These empty volumes consume part of the building cross-section and, in many cases, reach the same height as the living space. Usually wires for electricity, Internet, telephone, AC systems, etc. are placed under a raised flooring system; the ceiling is preferred for hiding services like lighting, fireproof systems or AC systems.

There are no references known of a concrete voided rectangular-shaped slab which at the same time reduces the weight of the structure and makes it possible to extend all the facilities through its interior being completely accessible.

A formwork used in the construction of waffle slabs for parking buildings uses inverted-open box-shaped parts placed with some distance between them. This space between boxes defines walls and above it, the surface of the floor. The final result is a slab with a succession of cavities at the bottom face that reduces the weight of the structure, but it cannot be used to hide or place any facilities and doesn't reduce the construction time. The cross-section of this kind of slabs is bigger than any other, without taking into account the space occupied by the ceiling and the flooring systems.

The U.S. Pat. No. 4,967,533 claims a type of slab that has inner holes but the lack of walls between holes make it impossible to create a network of channels able to receive the facilities mentioned. This slab is similar to other conventional slabs but with some additions above or at the bottom for the building services, but with no structural use.

There are steel lattice structures known that support reinforced concrete deck slabs allowing to place the facilities on the horizontal plane. There are also one-way beam structures made of concrete with specific holes not disposed on a reticular or systematic way. Other slabs have holes at the upper face but no side holes.

The U.S. Pat. No. 5,315,806 claims a concrete slab with its structure based on pyramids and upper and bottom reticular concrete structure with connected holes accessible only from one face.

There are one-way core slabs whose horizontal in line cores can contain the building services. The services are only accessible in specific points, not being accessible in the whole upper/bottom surface.

There are also reticular concrete slabs formed by combined tetrahedrons, developed by American architect Luis Kahn. Facilities can be laid only in one direction, instead of the 3 possible, in between the holes left by the concrete filling.

The U.S. Pat. No. 5,220,765 claims a slab formed by horizontal and vertical elements and a superior horizontal lid with limited resistance to shear, not having triangulation.

The slab claimed in this invention introduces a reticular structure formed by a reinforced concrete lattice work. This slab works as a hybrid between a solid concrete slab and a traditional lattice slab in which inner holes are introduced. These holes define a network of channels that allow the passing of all kind of facilities needed, including AC. The slab of this invention has:

a) Two main parallel reinforcements crossed and spaced out by other secondary reinforcements forming structural nodes in the intersection with the primary reinforcements.

b) A filling of minimum volume, preferably of concrete, where the said reinforcements are embedded forming structural nodes spread through the upper and bottom surfaces, along the primary reinforcements. Inner holes are left forming a network of channels in all directions.

c) A formwork that shapes the concrete filling, composed by truncated-pyramid-shaped volumes with smooth edges and apexes.

The inner holes are a basic and characteristic part of this invention. They are formed, in the structure, by the empty space left by a hypothetical prismatic volume and they open to the sides, at least in two of the opposite faces, connecting with the next volume, and creating a network of channels used for placing all kind of facilities (electricity, telephone, gas, water, etc.), or for allowing air conditioning circulation. These holes open also to the upper and/or bottom levels, creating through the said holes access to the inner channels.

The secondary reinforcements allow multiple configurations: a) in double diagonal thus forming nodes in the intersection with main reinforcements and in an intermediate crossing point; b) in diagonal thus forming nodes in the intersection with main reinforcements; c) or structural elements perpendicular to the main reinforcements.

In a possible embodiment the secondary reinforcements are resistant fibers included in the filling mass. Even, the secondary reinforcements could be form by the filling mass itself In a possible embodiment the secondary reinforcements are resistant fibers included in the filling mass. Even, the secondary reinforcements could be form by the filling mass itself. The filling mass replaces the secondary reinforcements, as the concrete of which is made the filling mass is resistant enough. There are different types of concrete, ones more resistant than others depending on their chemical composition and in many buildings allow to reduce and even to suppress reinforcements.

The primary reinforcements can be strengthened by other reinforcements crossed at 45° with the first ones. All the reinforcements can be wires, metallic profiles or also prestressed cables, depending on the technical requirements and whether the slab is manufactured in-situ or if it is a prefab element.

The primary and secondary reinforcements can be laid in parallel in the same direction, thus displaying a one-way structure, or in two directions thus displaying a two way structure.

They can also be laid in three directions thus displaying a three way structure.

The formwork used to manufacture this slab is also subject of this invention. Due to its special shape, it requires the design of new elements for the formwork system.

Different solutions are proposed to manufacture this invention:

The formwork can be recoverable and is formed by: a bottom plate that determines the side distance with the next module, a parallelepiped or truncated-pyramid-shaped part with its edges softened, thus defining the inner hole; and secondary volumes that fit in two or four sides of the main module. These pieces configure the side holes of the filling, preferable with bigger section in the lower part. It must be cylindrical or truncated-pyramid-shaped in order to make its extraction easier. These boxes can be made of a transparent material that makes it possible to check visually the correct pouring and compacting works.

A kind of formwork used in the building of a one-way structure is defined by semi-boxes. Each one forms one side face of the structure and half of the upper and bottom faces. A polyhedral projection is placed in the adequate zone in order to form the existing hole in the structure.

Another kind of formwork that can be used to build this slab, defines the inner hollows of the structure, can be recovered and it is formed by semi-sphere-shaped plates that connect with the next ones thus defining the holes for the inner channels. These parts are extracted from the upper or bottom levels through the hole that links, at least, one of the surfaces with the said holes.

A new kind of formwork that defines the inner holes of the structure consists of a permanent formwork formed by pieces made of synthetic material, mortar or ceramic, preferably isolating. Each one of these pieces forms, either by itself or joined with other pieces, each hole together with its communication with the next holes. This layout works as a network of inner channels.

Another formwork type is formed by two thin plates made of a synthetic or rubber material properly connected with each other that, once inflated, they come apart and define the distance between pieces. These parts define the inner hollows, and the spaces left for the structural nodes.

Another formwork type is formed by inflatable balloons with a reticular layout. They connect to the sides when they are inflated. They are related by a network of gas ducts attached to a pump (26).

This allows, once inflated, the construction of a prefab structure above them. When they are deflected the extraction can be done.

Flooring and ceiling supporting elements can be embedded in the structure filling. They can also work as separating elements for the reinforcements during the mounting works. The inner network of channels has an element that allows the reception of wires or any other building services.

There is also the possibility of including a system of recoverable covers that fit in the side holes of the modules and therefore allow for dividing the inner space and forming channels for air conditioning distribution or enclosing fire zones.

So far we have described a one-way or reticular plain structure. That said, if an element equipped with hollows is laid down following a straight line, it would create a beam, column or frame-like structure. If it follows curve lines, then it would define domes.

With a different configuration, this slab defines a central enclosure that separates the existing holes from the upper and bottom faces, thus creating a network of channels at both sides of the enclosure, that is to say, at the floor and at the ceiling.

Finally, in some cases secondary reinforcements can be substituted by resistant fibbers in the filling.

A slab like this, compared with a conventional slab in which the ceiling and floor systems have no structural function, presents bigger inertia moment allowing 30 meter spans without intermediate supports; with the corresponding saving in concrete and steel. As the floor and ceilings are supported directly by the slab there is no need for special devices to raise the floor or the ceiling.

The horizontal holes allow for placing all kind of facilities and the circulation of big flows of air conditioning in all directions defining a plenum distribution system, with no need or piping.

The horizontal holes allow for placing all kind of facilities and the circulation of big flows of air conditioning in all directions defining a plenum distribution system, with no need for piping. Given that the suspended ceilings are removable, the holes through which air circulates can be easily cleaned without any need for special cleaning equipments. This favors the eradication of the Sick Building Syndrome (SBS) which is produced by the accumulation of bacteria and other germs and that, in the case of hospitals, can have adverse consequences for patients.

Thanks to the horizontal configuration of holes, the slab can work as an acoustic absorption element, so no specific suspended ceilings are required to perform such a function. reduce and even to suppress reinforcements.

As the ceiling can be eliminated, it is possible to reduce the height between floors, about 40 cm in an office building, thus obtaining a better relation between the height of the building and the number of floors.

The advantages of this invention can be easily understood with the help of the description done following different examples. This description is based on the following figures, in which.

Figure 9A:
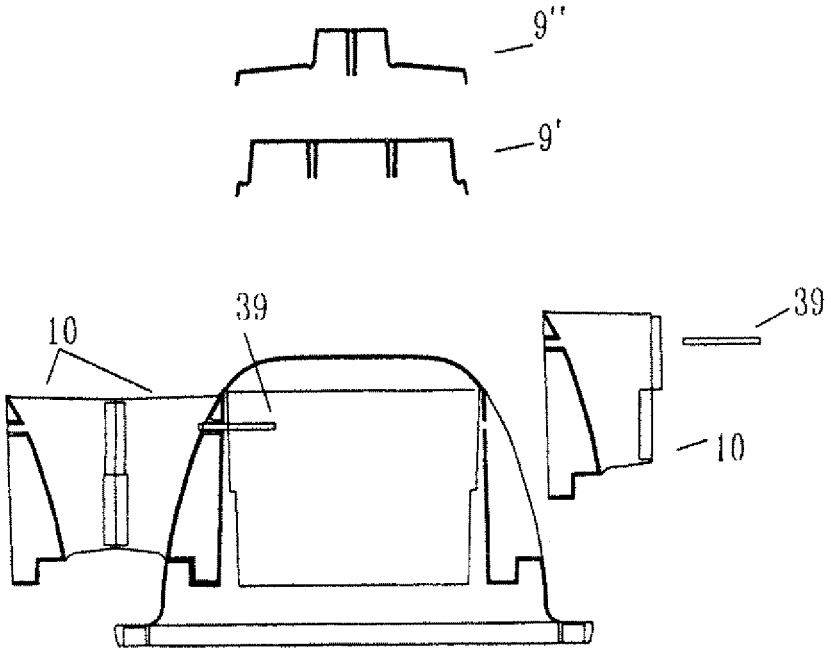

FIGS. 9*a* y 9 *b* show a cross section detail of two types of recoverable formwork with the side windows.

Figure 10:
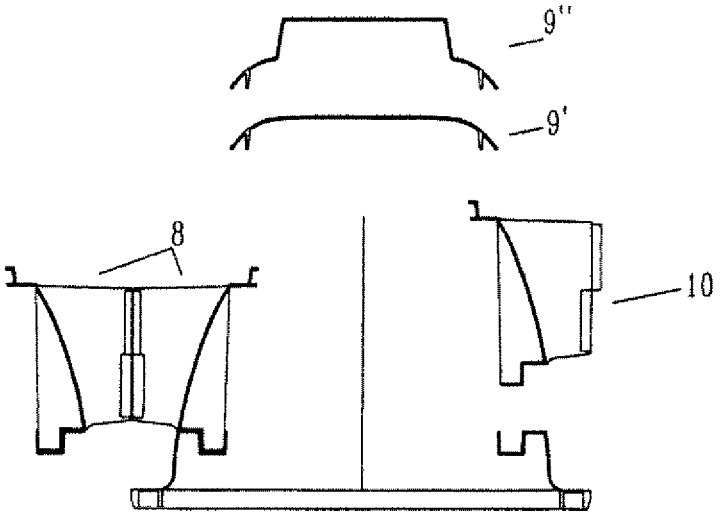
Figure 11:
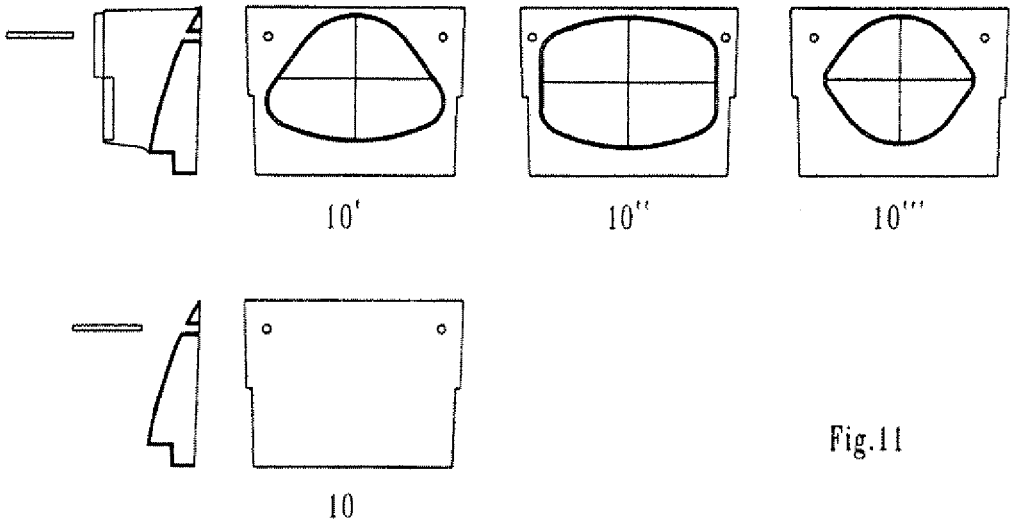

FIG. 10 shows a detail of one of the types of recoverable formwork that gets fitted due to the upper window formwork FIG. 11 shows possible geometric configurations of the side windows formwork.

Figure 12:
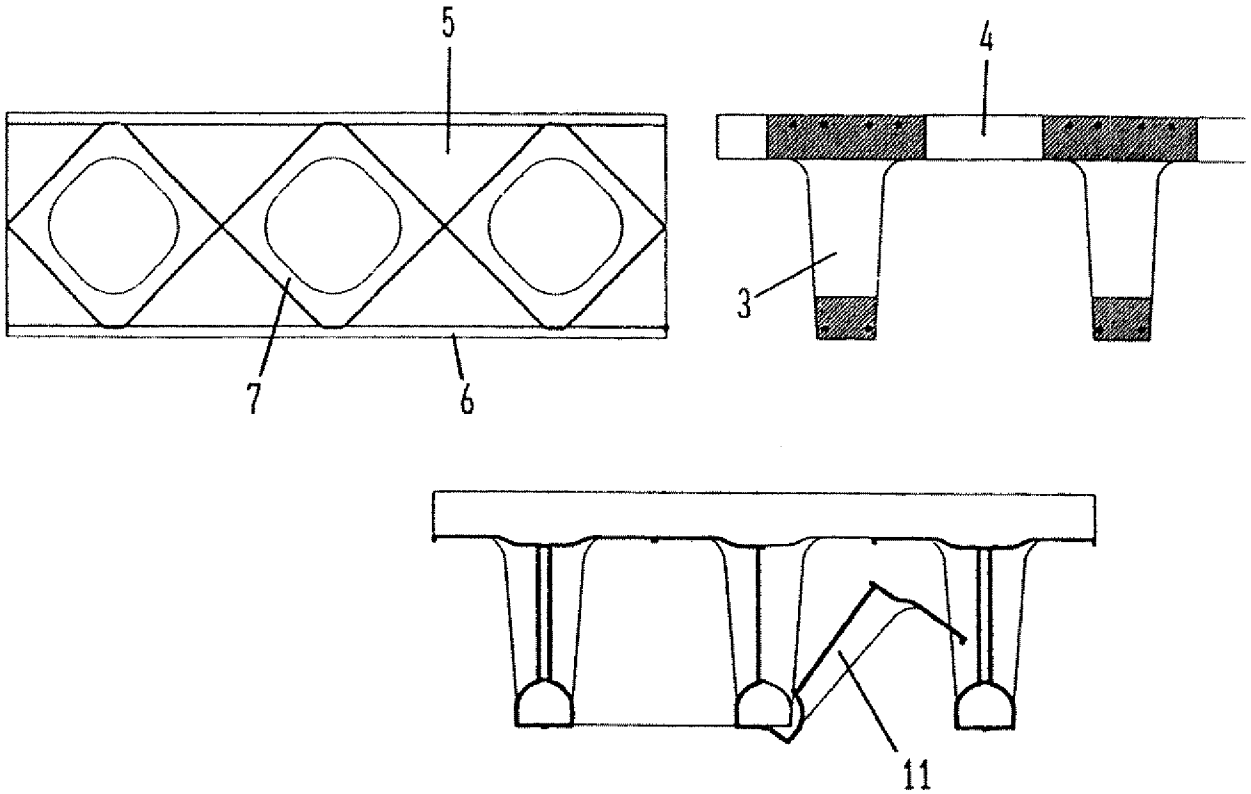

FIG. 12 shows in both cross-sections, following perpendicular planes, a one-way slab and the formwork to build it.

FIG. 13 shows another kind of a recoverable formwork for building this kind of slabs.

Figure 14:
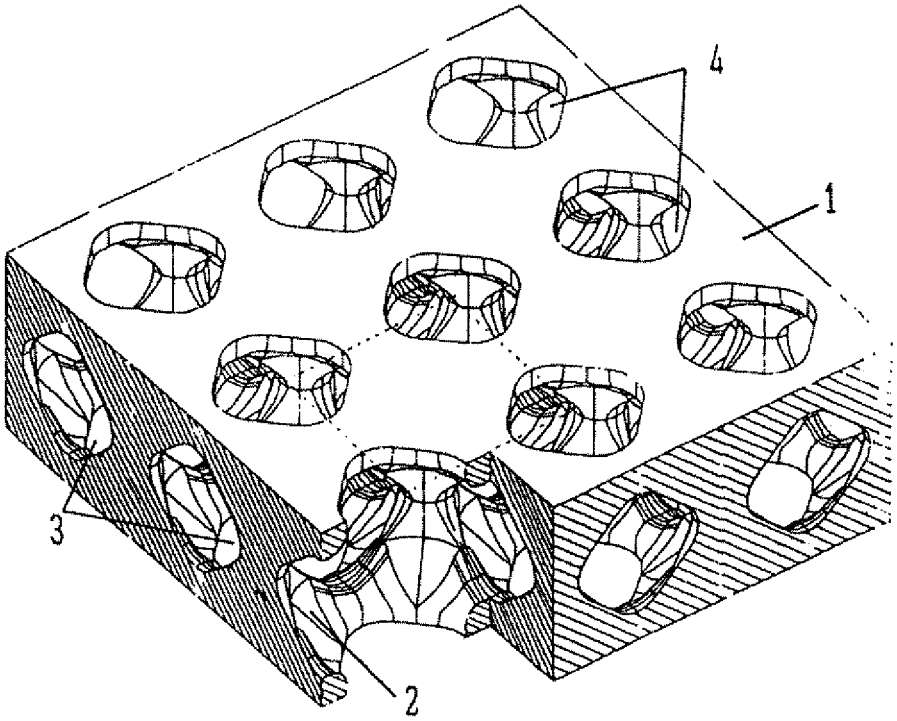

FIG. 14 shows a slab built with the formwork showed in FIG. 13.

FIG. 15 shows a view of a permanent formwork and a cross-section of the slab built with it.

Figure 16:
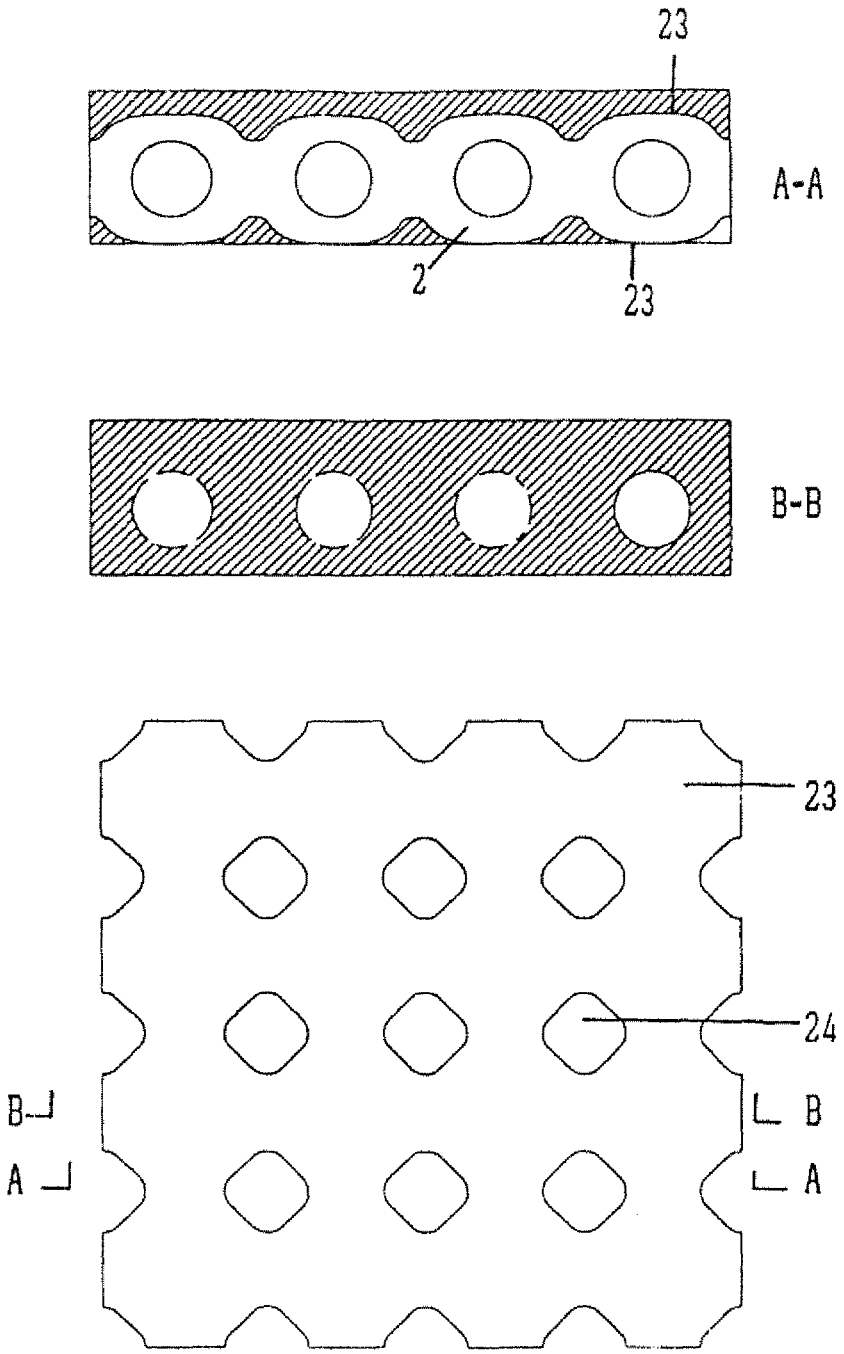

FIG. 16 shows a floor plan, with the sections marked on it, of a different possibility of inflatable formwork, for building this kind of slabs.

FIG. 17 shows two cross-sections, one during the process of mounting the slab and the other after finishing, showing another possible inflatable formwork.

Figure 18:
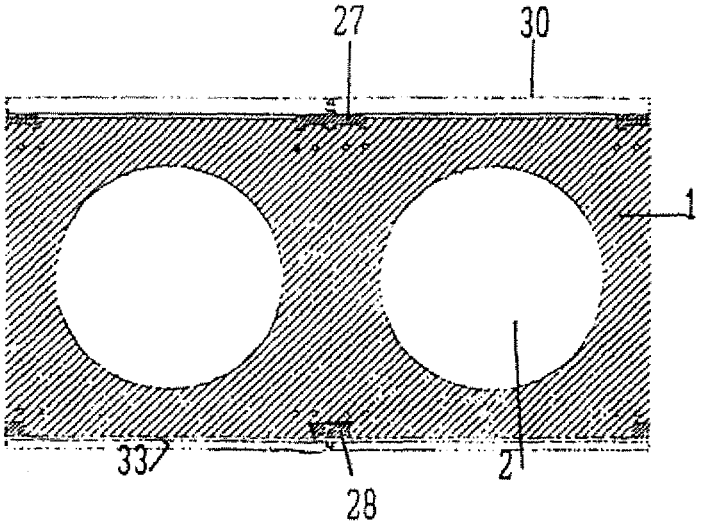
Figure 19:
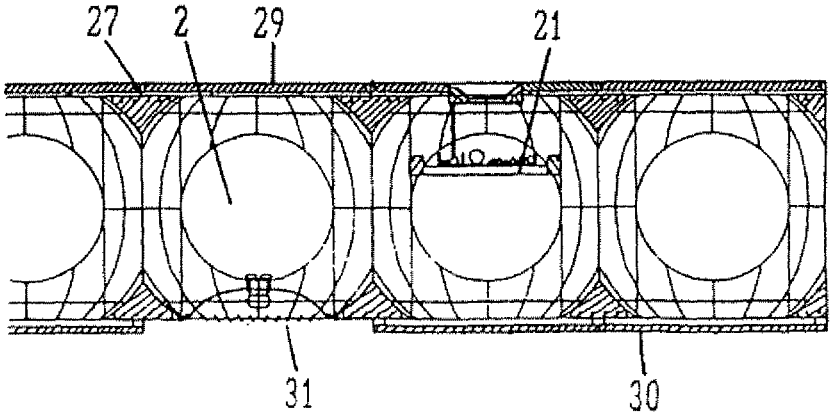
Figure 20:
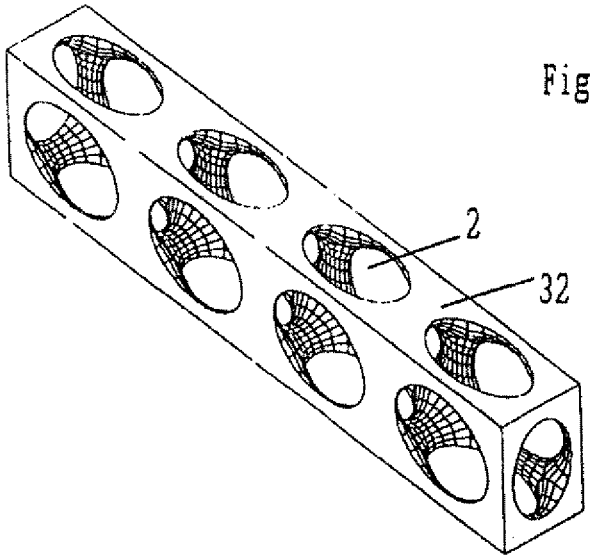
Figure 21:
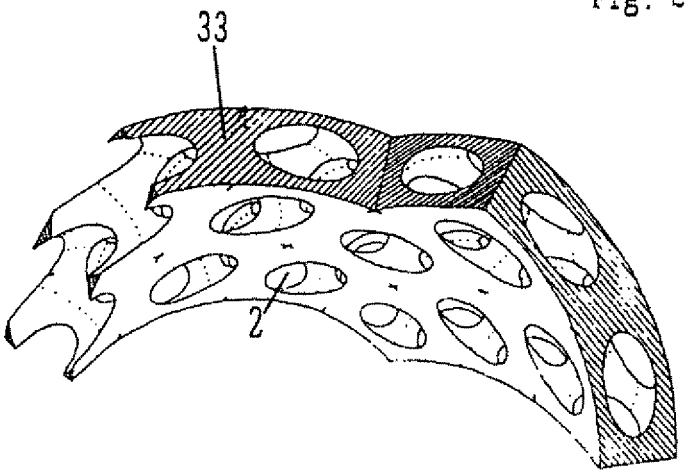

FIGS. 18 and 19 show two cross-sections done at different points of the slab built following the said invention including fittings for other elements FIGS. 20 and 21 show different uses of the formwork during the construction, in order to form linear structural elements or dome shaped ones.

Figure 22:
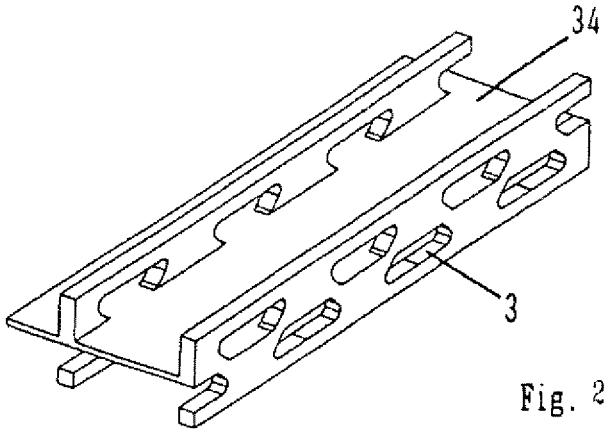

FIG. 22 introduces a perspective of a one-way slab that shows a specific configuration divided by a horizontal inner enclosure.

Figure 23:
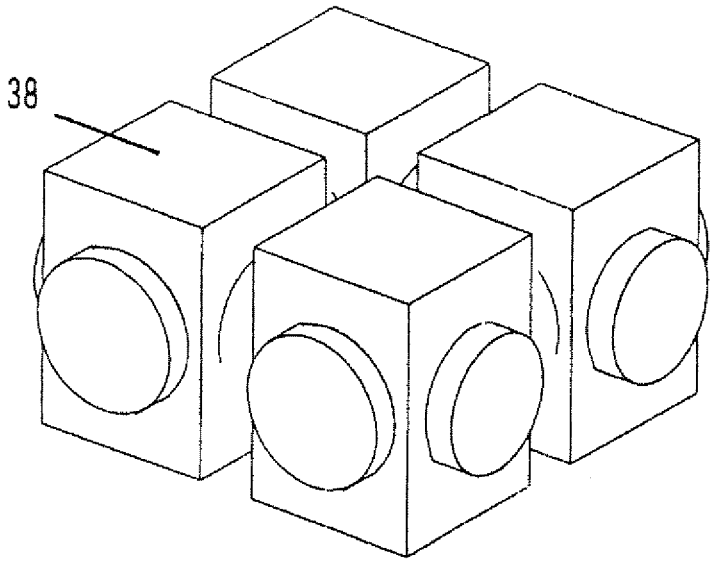
Figure 24:
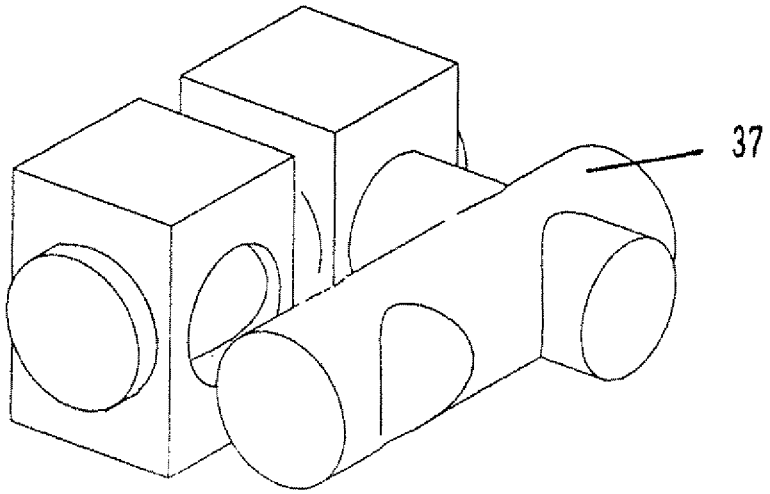

FIGS. 23 and 24 introduce in a schematic way a formwork made by cylindrical parts that fit into each other.

Figure 25:
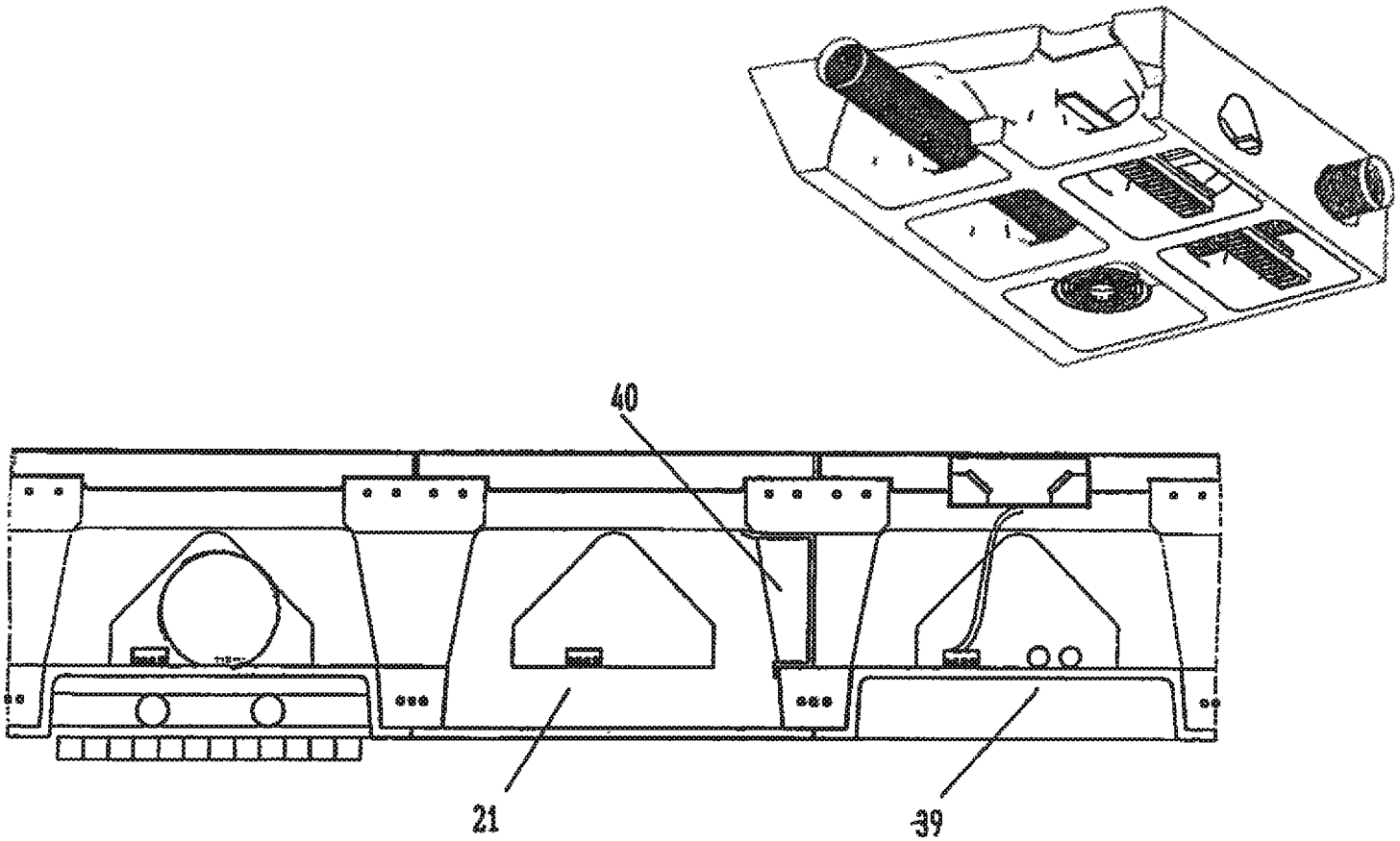

FIG. 25 introduces a cross-section of the facilities disposed through the holes and a partial axonometric view where it is shown the disposal of the facilities through the holes.

Figure 26:
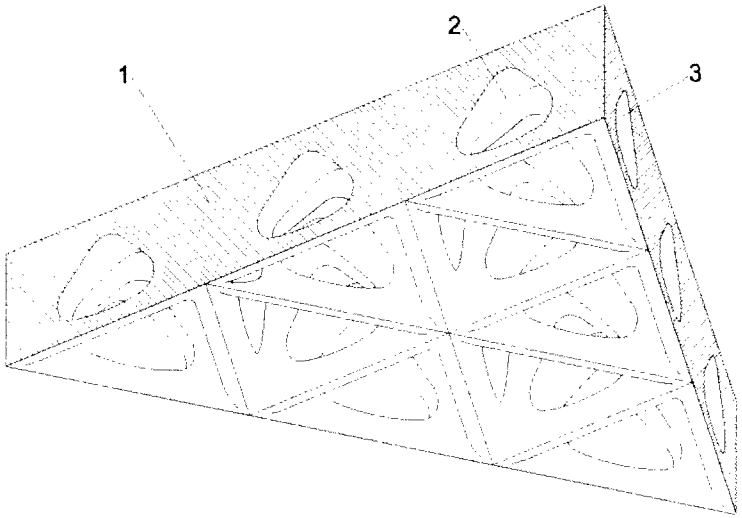

FIG. 26 shows a three-way slab conducted according to the same principles of the invention.

Figure 27:
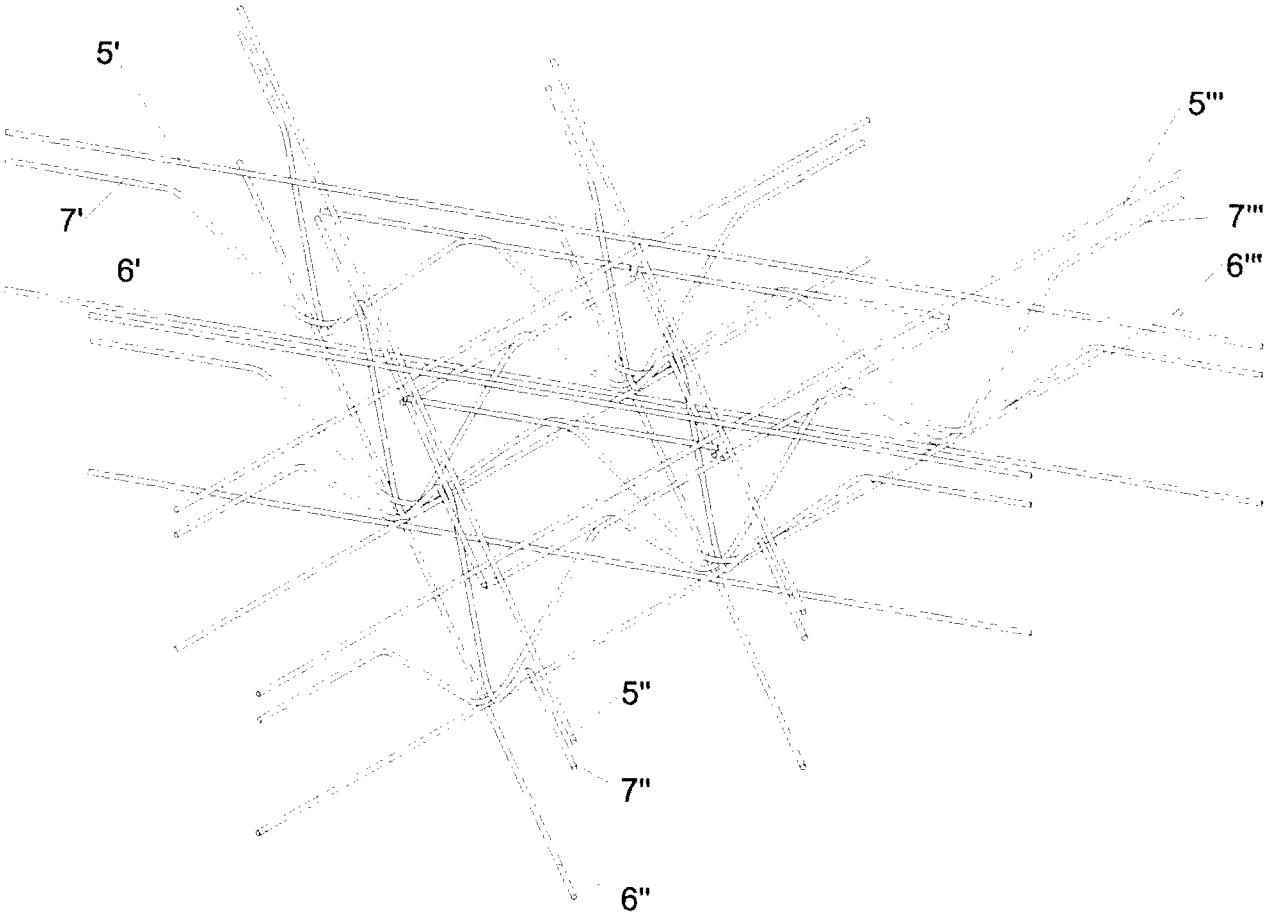

FIG. 27 shows the reinforcement employed in the construction of the three-way slab In the mentioned slab (1) introduced by FIGS. 1, 6, 7 and 14, we can observe a defined inner structure which is embedded in a minimum volume of concrete, leaving inside it hollows (2) that display a network of channels in all directions, which open to side (3) and/or upper (4) holes.

This slab (1) introduces a system of main steel reinforcements (5,6) superposed up and down the structure. They are spaced by other intermediate reinforcements called secondary reinforcements (7), forming a layout of structural nodes, with a configuration similar to a lattice slab.

Figure 1:
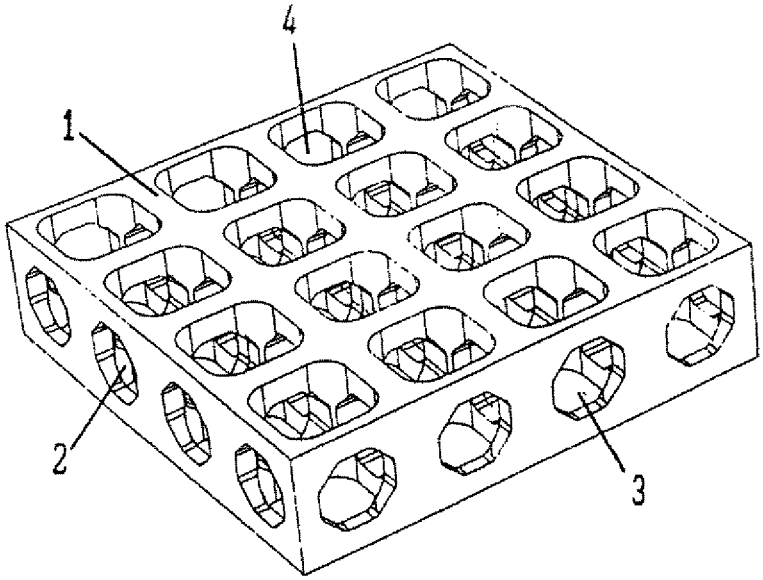
FIG. 1 shows/a preferential slab built according to the said invention.
Figure 6:
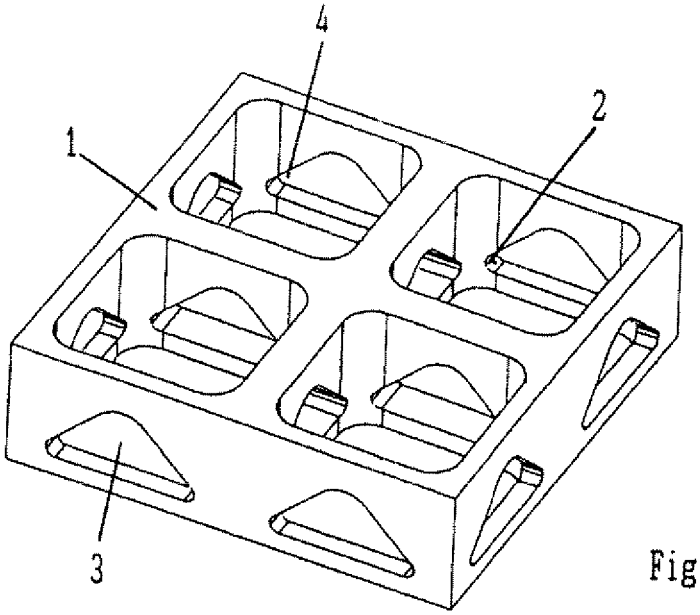
FIG. 6 shows a view of the two-way slab made from the reinforcement layout from FIG. 4.

As observed in FIGS. 1, 6 and 14, in the slab (1), the set of hollows (2) that defines the inner space, connects to the next by opening to the sides in order to form inner straight channels in one direction or in 2 reticular directions. These hollows (2) are open to holes (3) and (4) on upper and bottom surfaces. This allows the access to the inner network of channels, for installation of and/or maintenance works on the facilities installed there.

Figure 2:
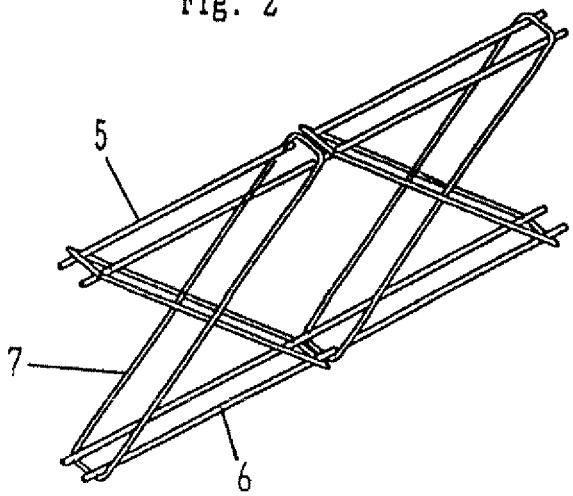
FIGS. 2 and 3, show two types of steel reinforcements suitable for building this slab.
Figure 3:
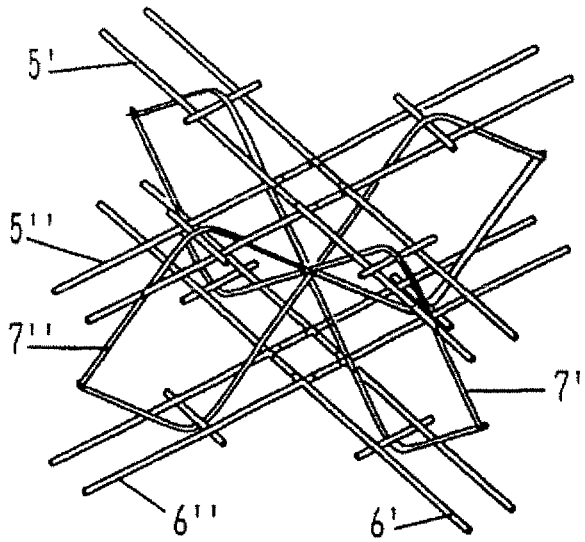

FIGS. 2 and 3, show two examples of one-way and two-way structures. FIG. 2 shows the main reinforcements (5) (6) separated by the double diagonal secondary reinforcement (7), both displayed in one-way parallel lines. FIG. 3 introduces an equivalent structure in which the main reinforcements (5'-5") and (6'-6") and the double diagonal secondary reinforcement (7'-7") cross in two directions, displaying a two-way reticular structure.

FIG. 26 shows a three-way slab, while FIG. 27 shows how the main reinforcements (5'-5") (6'-6") and secondary (7'-7") are crossed in three directions as shown in the figure, forming, when being embedded in the filler, a three-way structure.

Figure 4:
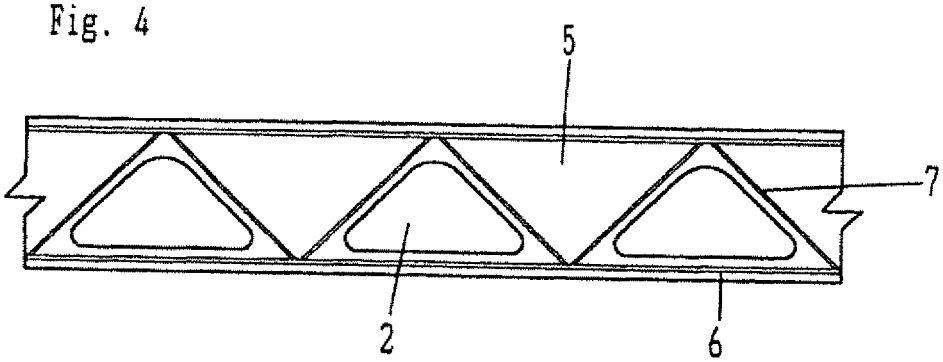
FIG. 4 shows a cross-section of the slab that shows secondary diagonal reinforcements.
Figure 5:
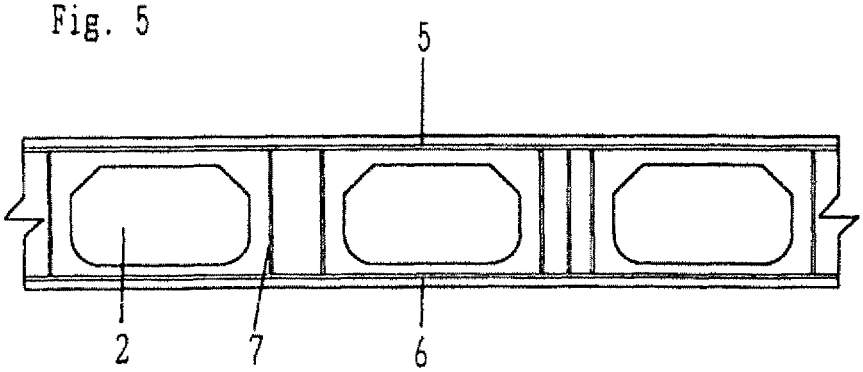
FIG. 5 shows a cross-section of the slab with secondary reinforcements formed by perpendicular structural elements

The secondary reinforcements allow different configurations. FIGS. 2 and 3 show a double diagonal configuration, forming internal and external nodes in the points of intersection with main reinforcements (5) or (6). In FIG. 4 another different disposal is represented, where the secondary reinforcements form a diagonal configuration. Finally, FIG. 5 shows a reinforcement in which the secondary elements are perpendicular to the main elements.

Figure 7:
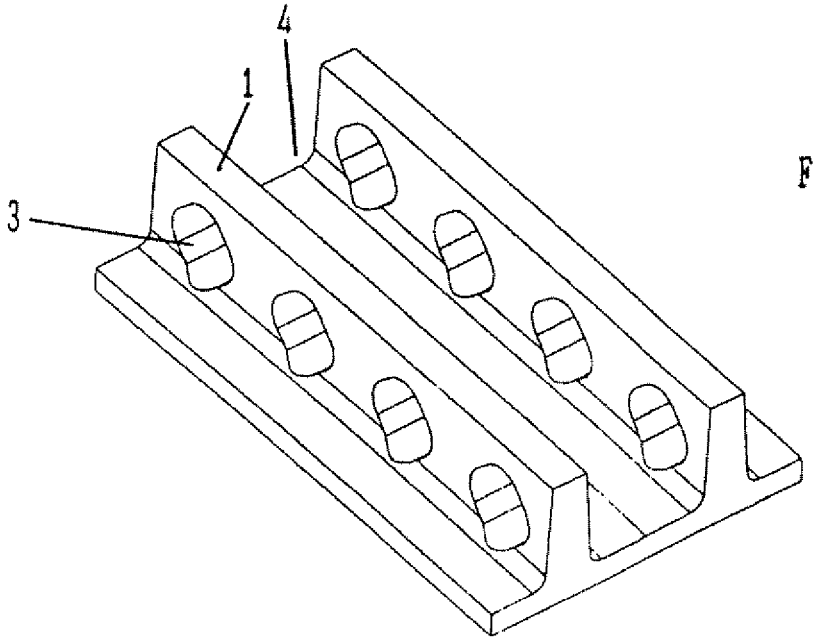
FIG. 7 shows another view of the slab built according to the one way structure version with double diagonal secondary reinforcement.

FIG. 6 shows an example of two-way structure slab, with diagonal secondary reinforcements, opened to upper and bottom surfaces, and to the sides. FIG. 7 introduces a one-way slab, with the reinforcements displayed in double diagonal. In both cases we can observe a plurality of holes (3) which are linked to the sides through the existing holes, creating side channels. In the two-way example, these hollows (2) are opened to other holes (4), at least in the upper or bottom surfaces; while in one-way example, the holes in the secondary structures direction are channels that link to each other through holes. They are opened at least to the upper or bottom surfaces and closed to the opposite face.

FIG. 7 shows a slab with its main and secondary reinforcements, lying parallel in one direction thus creating, once the filling is poured, a one-way structure.

Figure 8:
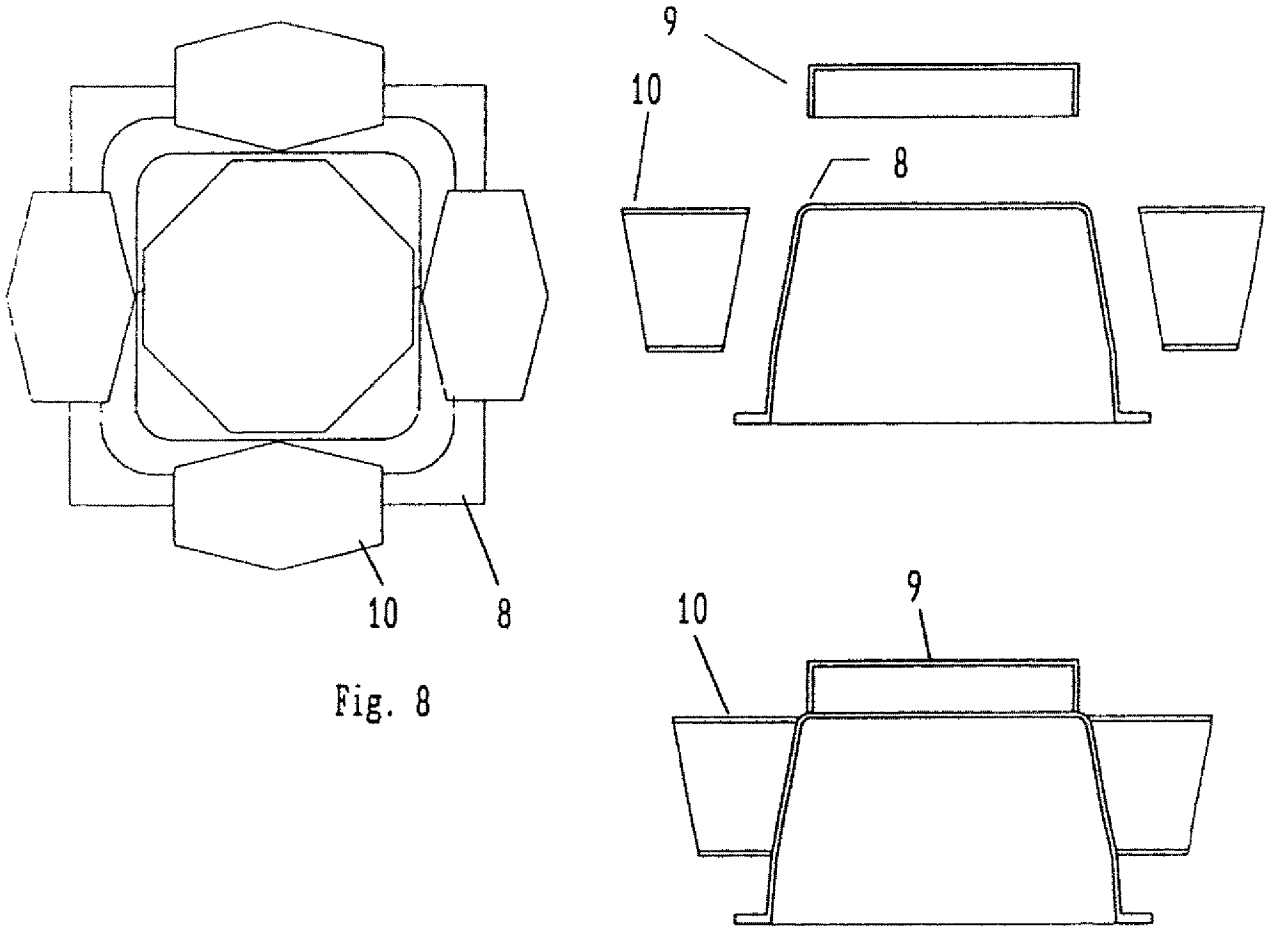
FIG. 8 shows two views (plan and cross section) of a recoverable formwork system, used for the construction of these slabs, showing mounted and partially displayed cross sections.

A formwork able to build this kind of slab is shown in FIG. 8. This formwork is recoverable and is formed by a) bottom plate, that determines the distance between modules and supports the structure and the filling; a parallelepiped or truncated-pyramid (8) with smooth edges defines the hollow main volume (2) of the slab; b) secondary volumes (10) that fit in the sides in two or four faces, configuring the side holes of the filling. These volumes are preferably manufactured with bigger cross-section in the cylindrical or truncated-pyramid-shape, bottom part, to make extraction easier. c) upper window coupled from the top, to make the extraction from below easier (9)

The secondary volumes or windows are fitted in the main volume and are shaped by two truncated-cone-shaped halves that fit in each other to prevent movements. The edges are smooth to make extraction easier through the hole left by the main formwork.

In FIG. 11, the secondary volumes or windows of the formwork can be closed (10) or open with different interchangeable sizes depending on secondary reinforcement (10') (10") (10''') adapting the system to solid zones or to different facilities needs.

Figure 9B:
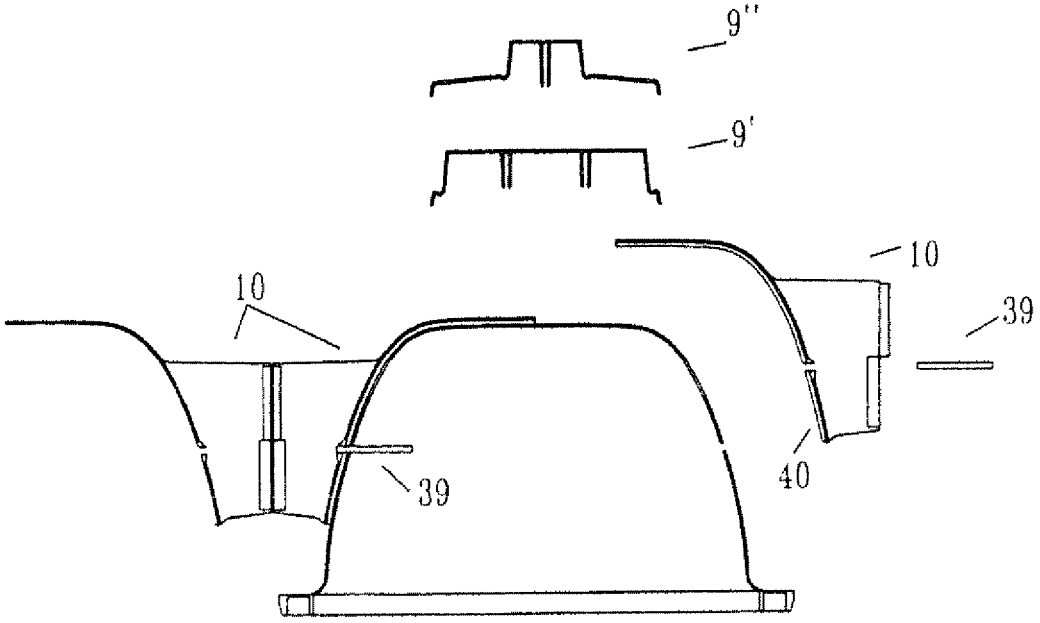

Depending on the fitting way of the side windows and the main volume, there are different kinds of joints between them. In FIG. 9*a* the side secondary volumes of the formwork fit and move vertically with respect to the main piece. They are fixed with overlaps to allow the extraction once the concrete is poured. In FIG. 9*b* the secondary volumes of the formwork have a geometry parallel to the supporting cube, that prevents the movement of the piece. Another piece of elastic material seals the joint between them.

FIG. 10 shows another case in which the formwork upper holes tie the side windows thus making the formwork work as a whole, not being needed a complete main bucket.

Through perforations in the side windows, transverse fittings are placed (39) to prevent the vertical movement of the pieces due to the pressures produced by the concrete pouring. Such fittings should be taken away before removing the pieces.

The formwork upper surface holes can have different sizes (9') (9") and be interchanged depending on the needs. They can be used as a pass for small section services. If the section is bigger, they can be used for checking the services from the upper surface, or to form a tridimensional lattice work.

To avoid the displacement of the formwork upper secondary volumes, they are fitted or screwed to the main volume.

In a realization of the formwork, the boxes (9) and tubular side elements (10) are made of a transparent synthetic material that allows the visual checking of the pouring and compacting of the filling, before the extraction is done. Optionally, this formwork can have holes to let the air left by the pouring escape.

In FIG. 12 is shown a similar formwork to the one explained above when is a one-way structure. This formwork is formed by semi-boxes (11). Each one of them shapes one side face of the structure and half of upper and bottom faces and introduces a polyhedral projection that shapes the existing hole (3) of the structure.

Another possible formwork method is introduced in FIG. 13, formed by a layout of plates (12) that define the bottom surface which supports the slab. These plates (12) define points on which semi spherical elements (13) lay down in net distribution. These elements define the holes inside the slab. These elements connect with each other to create the inner network of channels. In the example shown, the semi spherical shaped elements (13) define a bolt cap (16) apt to constitute an axis of rotation to engage against a stop (17) located in the supporting plate (12). The mounting of four of this elements forms a spheroid that is closed by an auxiliary piece (14), fixed on the top part of the spheroid. The bottom holes are defined by the supporting plate (12). The side holes are formed when the spheroid is connected to the next one.

The extraction of these pieces, is done by removing the upper cover (14), and forcing one of the semi spheres (13) to open to the interior of the hole, from where it is removed through one of the holes.

There is also the possibility of carrying out the extraction process from below, taking away the plates (12) first.

FIG. 14 introduces a part of the slab obtained with this kind of formwork. The result is a sponge look piece, full of inner holes (2), that link the side holes (3) and also to the upper holes (4).

FIG. 15 introduces another way of permanent formwork consisting of pieces with semi spherical shape (18), made of expanded polystyrene or any other synthetic material with the same isolating characteristics and strength enough to bear the formwork above it. Two semi spheres (18) fit in each other and allow, joined to the next one by their holes, to define the layout of holes that characterizes this building technique. In this case, the slab has its upper surface closed continuously, because of the enclosure of the semi spheres (20). This allows the concrete pouring above the formwork and the creation of a continuous surface without the typical holes of this slab system.

As it is observed in the vertical cross-section represented in FIG. 15, in the channels inner space defined by the holes (2) it is possible to place elements (21) in order to fix several wires or channels, it is possible likewise to place channels (22) directly in the inner space, which are accessible through the hole created in the bottom of the ceiling, because in this case the upper face of the slab is closed. In this model, as the inner holes which defined the channels are covered by an isolating material, they can be used directly for the transport and driving of the air conditioning.

It is also possible to include an inner system of recoverable covers that fit in the side holes of the main holes thus allowing the division of the inner space and the creation of AC channels or fireproof zones. In the perimeter holes of the slab, moving or static objects can be placed, allowing the entrance and exit of air, and the expulsion of gasses produced by the fire through the inner holes. In FIG. 16 another way of building a permanent formwork is represented, composed in this case by two thin plates (23) made of synthetic or rubber materials. These plates are properly joined to define, once inflated, bulges which will form the holes in the slab (2). There are also some cuts (24) correctly welded in its perimeter through which the reinforcements of the slab should be displayed.

This kind of slab is very easy to install because there is no moving, permanent or recoverable parts. A big surface can be displayed in a short time.

The formwork represented in FIG. 17 is another variation of the slab described above. It is formed by a plurality of balloons (25) that define the existing holes of the said formwork. The whole set of balloons (25) is related through the bottom part by a network of channels (26), so that when they are inflated, they achieve the configuration represented in the figure and, once the pyramidal structures are mounted in the inner spaces between the balloons, with the corresponding upper and bottom reticular reinforcements, and the concrete is poured, once the balloons are deflected, they can be extracted from the bottom level. This configuration is optimal to create prefab pieces with these characteristics.

FIG. 18 shows the supporting elements (27) (28) for the flooring and ceiling systems, which also define, during the building works of the slab, the distance elements of the reinforcements during the mounting.

FIG. 19 represents a slab with floor (29) and ceiling (30). The bottom holes (2) were used to hide the lighting devices (31), in other holes the wire trays (21) are located to receive the services that pass through the slab. Another option of this configuration can be formed by a slab working as a ceiling covered by diffuse elements that allow, during the day, the passing of light through the holes of the slab. During the night the lighting devices (31) are placed in the bottom holes.

FIG. 20 introduces an element beam or column shaped (32), with the same disposal as the slab of the invention, in the way of a concrete structure with holes (2) in its inner space, displaying structural lattice work nodes. It can be used for aesthetic or architectural uses.

In the case of a hypothetical prismatic volume that is extended following curve lines, we can reach the configuration displayed in FIG. 21, in which we can see the configuration of a dome full of holes, displayed in a reticular way and separated by nodes that introduce the reinforcements.

FIG. 22 shows a slab similar to the one explained in FIG. 7, but with an enclosure (34) that separates the existing holes into the upper and bottom faces, creating a network of channels at both sides of the enclosure, that, is to say, at floor level and at ceiling level. In this case, the secondary reinforcements are diagonal and built in-situ in two phases: in the first one, after placing the boxes and side holes, the filling is poured in the bottom part and the enclosure; in the second phase, after placing the main formwork boxes and side holes, the filling is poured on the upper part.

In the construction of the slab claimed in the invention, the main bottom and upper reinforcements can be wires that can be stressed in situ or pre-stressed in factory; this transmits pressure to the filling, and makes it more bending resistant. The volume of filling compared to the volume of holes can be changed according to the resistance required in specific zones of the structure. The reinforcements in the critical points can be formed by rolled profiles. There is also the possibility of substituting the secondary reinforcements by introducing resistant fibbers in the filling.

FIGS. 23 and 24 show a simple formwork formed by cylinder intersection (37), placed in 3 directions that intersect. They are removable as they fit in a parallelepiped (38) or in each other.

FIG. 25 reintroduces a cross-section, where the wire trays (21) are seen passing through the holes. These trays can also be directly hanged from the bottom structural ribs of the slab.

These trays can be the support of lighting appliances and other elements, as seen on the view There is also the possibility of displaying covers for the side (40) and bottom (39) holes working as a ceiling and defining zones where the air is distributed in a plenum way, with no need for specific ductwork. In the axonometric view, instead of plenum, a conventional air circulation system is disposed through flexible vent pipes and diffusers.

The invention claimed is:

1. A lightweight slab that can receive facilities which will be extended through the slab comprising:

two main parallel reticular reinforcements (5, 6) extending parallel to one another;

secondary reinforcements extending between the two main parallel reticular reinforcements and arranged to form a double diagonal, a single diagonal or a perpendicular relationship with the main reinforcements to form a series of structural nodes;

all of the reinforcements embedded in a volume of concrete filling which covers and protects such reinforcements according to structural concrete regulations, the volume of concrete filling defined during its production by a formwork or mould to create a hollow main volume (2) of the lightweight slab the formwork or mould formed by hollow prismatic or truncated-pyramid-shaped volumes with smooth edges and vertices that improve structural strength and facilitate the extraction thereof when it is necessary to retrieve the moulds; and characterized in that the concrete filling defines open holes (4, 3) adjacent the secondary and main reinforcements to form a succession of nodes connected to one another to form a network of open channels of the lightweight slab which extend in all directions through the hollow main volume (2) and the open holes (3, 4) and that are configured to be accessed from a lower level, upper level (4), and sides (3) for receiving any type of facilities such as electricity, telecommunications, plumbing, air conditioning or ventilation equipment.

2. A lightweight slab as set forth in claim 1 wherein the secondary reinforcements are either the filling themselves or resistant fibers in the filling, and the upper and lower main reinforcements being cables which when pre-stressed, will transmit a compression to the filling for providing the slab with greater resistance to bending.

3. A lightweight slab as set forth in claim 1 wherein the main (5, 6) and secondary (7', 7") reinforcements are extended in parallel through one and only one direction to configure a one way structure embedded in the filling.

4. A lightweight slab as set forth in claim 1 wherein the main (5', 5"), (6', 6") and secondary (7', 7") reinforcements cross in two directions configuring a two-way structure embedded in the filling.

5. A formwork or mould wherein the formwork or mould is recoverable and comprising:

a) a plate (8) that defines a side distance between modules, fixed to a truncated-pyramid-shaped piece (9), with smooth edges that defines an inner hole and is a main volume of the formwork;

b) secondary volumes or lateral windows (10) in which the four sides of a main piece are fitted and configure side holes of the system wherein its cross-section is bigger in the cylinder/truncated-pyramid-shaped pieces lower end for making extraction of the formworks easier; and c) a volume or upper window coupled from a top and having a truncated-cone-shape for making extraction from below easier.

6. A lightweight slab as set forth in claim 1 wherein the main (5'-5")(6'-6"), and secondary (7'-7") reinforcements cross in three directions configuring a three-way structure embedded in the filling.

7. A lightweight slab as set forth in claim 1 wherein the lightweight slab created from a prismatic volume (32) with an inner hole extends linearly forming a beam, column or frame structure to configure a load-bearing wall when its layout is horizontal.

8. A lightweight slab as set forth in claim 1 wherein a central enclosure (34) separates the holes between upper and bottom faces to create the network of channels to both sides of the enclosure.

9. A lightweight slab as set forth in claim 1 further comprising:

wire trays (21) placed across the holes and supported by lower ribs of the lightweight slab structure;

movable or fixed elements configured to allow air inlet and outlet, directly or through pipelines; and side and bottom hole (40) covers (39) defining plenum air distribution zones so it is not necessary to place specific conduits.

10. A lightweight slab as set forth in claim 1 wherein each one of the nodes contains supporting elements for a floor (27) or for a ceiling (28) which are pallet-deck spacers for the reinforcements during their assembly.

11. A formwork or mould as set forth in claim 5 further comprising:

wherein the formwork secondary volumes (10) used in the construction of the slab are fixed to the main volume and are formed by two truncated-cone-shaped halves that fit in each other to prevent its relative movement and the smooth edges of the truncated-pyramid shaped piece (9) making the extraction easier from the hole left by the main piece;

wherein the lateral windows can be closed or open with different sizes (10')(10")(10''') being interchangeable and can be adapted in case of meeting solid zones or different equipment facilities needs;

the secondary volumes (10) used in the construction of the slab fit in the main piece capable of moving vertically;

the secondary volumes attached to the main piece by overlapping parts to allow the extraction of the system once the concrete filling is poured;

the secondary volumes having a geometry parallel to the main formwork that prevents the displacement of the piece;

a part made of elastic material sealing a joint between pieces;

the secondary volumes being dowelled and joined (39) to prevent vertical displacements thereof due to the pressure produced during the concrete pouring stage;

the upper windows (9) used in the construction of the slab having different sizes and capable of being interchanged depending on the use needed (9') (9");

the parts capable of receiving small cross-section facilities wherein if the section is bigger, they can be used to access facilities from the top or to form a three-dimensional lattice work; and upper windows (9') (9") used in the construction of the slab to tie all the side formwork together thus making the formwork system work as a whole.

* * * * *

UNITED STATES PATENT AND TRADEMARK OFFICE

CERTIFICATE OF CORRECTION

PATENT NO. : 8,943,771 B2
APPLICATION NO. : 13/807609
DATED : February 3, 2015
INVENTOR(S) : Garcia It is certified that error appears in the above-identified patent and that said Letters Patent is hereby corrected as shown below:

In the Specification,

Column 2, Lines 48-51 should be completely removed as it is duplicated.

Column 4, Lines 19-22 should be completely removed as it is duplicated.

Signed and Sealed this
Second Day of June, 2015

Michelle K. Lee

Michelle K. Lee
*Director of the United States Patent and Trademark Office*